US006755684B1

(12) United States Patent
Hueniken et al.

(10) Patent No.: US 6,755,684 B1
(45) Date of Patent: Jun. 29, 2004

(54) MULTIPLE AXIS CONNECTION SYSTEM

(75) Inventors: Peter Hueniken, Chatham (CA); John Ceccacci, Chatham (CA); Vic Derbowka, Chatham (CA)

(73) Assignee: Siemens Canada Limited (CA)

( * ) Notice: Subject to any disclaimer, the term of this patent is extended or adjusted under 35 U.S.C. 154(b) by 0 days.

(21) Appl. No.: 09/639,083

(22) Filed: Aug. 16, 2000

Related U.S. Application Data

(60) Provisional application No. 60/149,041, filed on Aug. 16, 1999.

(51) Int. Cl.[7] ..... H01R 13/60; H01R 13/627

(52) U.S. Cl. ..... 439/532; 439/355

(58) Field of Search ..... 439/532, 541.5, 439/310, 350, 352, 353, 355

(56) References Cited

U.S. PATENT DOCUMENTS

| | | | | |
|---|---|---|---|---|
| 3,569,939 A | | 3/1971 | Garver | 339/91 |
| 5,788,522 A | | 8/1998 | Kameyama | 439/248 |
| 6,019,521 A | * | 2/2000 | Manning et al. | 385/77 |
| 6,045,384 A | * | 4/2000 | Norizuki et al. | 439/310 |
| 6,196,869 B1 | * | 3/2001 | Kay et al. | 439/532 |

FOREIGN PATENT DOCUMENTS

| | | |
|---|---|---|
| EP | 0 374 918 A1 | 6/1990 |
| EP | 0 415 489 A1 | 3/1991 |
| GB | 2 218 277 A | 11/1989 |

* cited by examiner

*Primary Examiner*—Chandrika Prasad

(57) ABSTRACT

A connection system is provided for restraining a component in three orthogonal directions on a mounting surface. Pairs of first and second projections are disposed on opposing surfaces of the component symmetrically about a component axis. The first and second pairs of projections are spaced along the component axis. Two grooves are disposed on the mounting surface parallel to the axis for engagement with the projections. Each groove has a C-shaped channel on a surface facing the component, and each channel has an aperture in a location corresponding the mounting position of the component. During mounting, the projections slide within the channels until ends of the first projections engage the apertures. The connection system of the present invention restrains the component in three orthogonal directions, centers the component in its mounting location, and reduces vibration levels. The inventive connection system further provides an audible and visible indication when the component is locked in place. Further, the connection system of the present invention is lightweight and easy to disengage, allowing for quick removal of the component for replacement or repair.

11 Claims, 3 Drawing Sheets

MULTIPLE AXIS CONNECTION SYSTEM

CROSS REFERENCE TO CO-PENDING APPLICATIONS

This application claims the benefit of the earlier filing date of U.S. Provisional Application No. 60/149,041, filed Aug. 16, 1999, the disclosure of which is incorporated by reference herein in its entirety.

FIELD OF THE INVENTION

This invention relates to a connection system for a component, such as a sensor, which provides a restraining force on the component in three orthogonal directions, while centering the component in its mount and reducing vibration levels.

BACKGROUND OF THE INVENTION

Many machines and other devices utilize a number of smaller components to carry out tasks essential to the operation of the overall device. These components are typically mounted on a housing of the device or on the device itself. Designers of all types of equipment are faced with similar constraints regarding the layout and arrangement of components. These constraints include size, weight, alignment, vibration, assembly, access, and serviceability.

Existing mounting arrangements have included screws and heat stakes for securing components in place, rubber mounts for reducing vibration, and additional parts to ensure the proper alignment and centering of components with respect to the overall device.

Known mounting arrangements have proven to be inadequate in several regards. External mounting hardware takes up valuable space and increases the weight of components. Mounts may wear out prematurely and lead to component failure. Fixed mounting arrangements make components difficult to access and remove, in some cases rendering the parts unserviceable. Lastly, additional external mounting hardware increases the time for assembly and disassembly, leading to higher equipment costs.

There is a need for a component mounting system that provides the required retention, centering, and vibration damping of the component, yet is lightweight and easy to engage and disengage.

SUMMARY OF THE INVENTION

The claimed invention provides an integral component connection system that restrains the component in three orthogonal directions, centers the component in its mounting location, and absorbs vibration. The inventive connection system further provides an audible or visible indication when the component is connected. Further, the connection system of the present invention is lightweight and easy to disengage, allowing for quick removal of the component for replacement or repair.

The claimed invention provides a system for connecting a male member to a female member, the male and female members being relatively displaceable substantially along an axis lying in a plane. The system comprises a pair of first projections each extending parallel to the plane and each having a first end spaced from a second end, each first end being fixed to a first one of the male and female members, and each second end being resiliently movable with respect to the first member, each second end including a first one of a cavity feature and a protrusion feature; and a pair of grooves in a second one of the male and female members, each groove extending parallel to the axis and receiving a respective one of the pair of first projections, and each groove including a second one of the cavity feature and the protrusion feature, the second feature cooperatively engaging the first feature such that the first member is centered about the axis with respect to the second member and such that the first member is retained along the axis with respect to the second member.

The claimed invention also provides a system for connecting a male member to a female member, the male and female members being relatively displaceable substantially along an axis lying in a plane. The system comprises a pair of first projections each extending parallel to the plane and each having a first end spaced from a second end, each first end being fixed to a first one of the male and female members, and each second end being resiliently movable with respect to the first member to absorb relative vibration between the male and female members; a pair of grooves in a second one of the male and female members, each groove extending parallel to the axis and receiving a respective one of the pair of first projections; a tip formed on each second end and an aperture extending from each groove through the second member, each tip tapering from a first size at least as large as its corresponding aperture to a second size smaller than the corresponding aperture, and each tip cooperatively engaging its corresponding aperture such that the first member is centered about the axis with respect to the second member and such that the first member is retained along the axis with respect to the second member; each tip being visible in its corresponding aperture when the first member is retained along the axis with respect to the second member and a pair of second projections fixed to the first member and extending parallel to the plane, each second projection having at least two faces slidingly engaging corresponding surfaces in each groove to prevent relative displacement of the first and second members perpendicular to the plane.

The claimed invention also provides a method of connecting a male member to a female member, the male and female members being relatively displaceable substantially along an axis lying in a plane. The method comprises providing a first one of the male and female members with a pair of first projections each extending parallel to the plane and each having a first end spaced from a second end, each first end being fixed to the first member, and each second end being resiliently movable with respect to the first member, each second end including a first one of a cavity feature and a protrusion feature; providing a second one of the male and female members with a pair of grooves, each groove extending parallel to the axis and receiving a respective one of the pair of first projections, and each groove including a second one of the cavity feature and the protrusion feature; aligning the male member with respect to the female member along the axis such that each groove will receive a respective one of the pair of first projections; and relatively displacing the male member with respect to the female member until the second feature cooperatively engages the first feature such that the first member is centered about the axis with respect to the second member, the first member is retained along the axis with respect to the second member, and relative vibration between the first and second members is absorbed.

BRIEF DESCRIPTION OF THE DRAWINGS

The accompanying drawings, which are incorporated herein and constitute part of this specification, illustrate presently preferred embodiments of the invention and, together with the general description given above and the detailed description given below, serve to explain features of the invention.

DETAILED DESCRIPTION OF THE PREFERRED EMBODIMENTS

Figure 1:
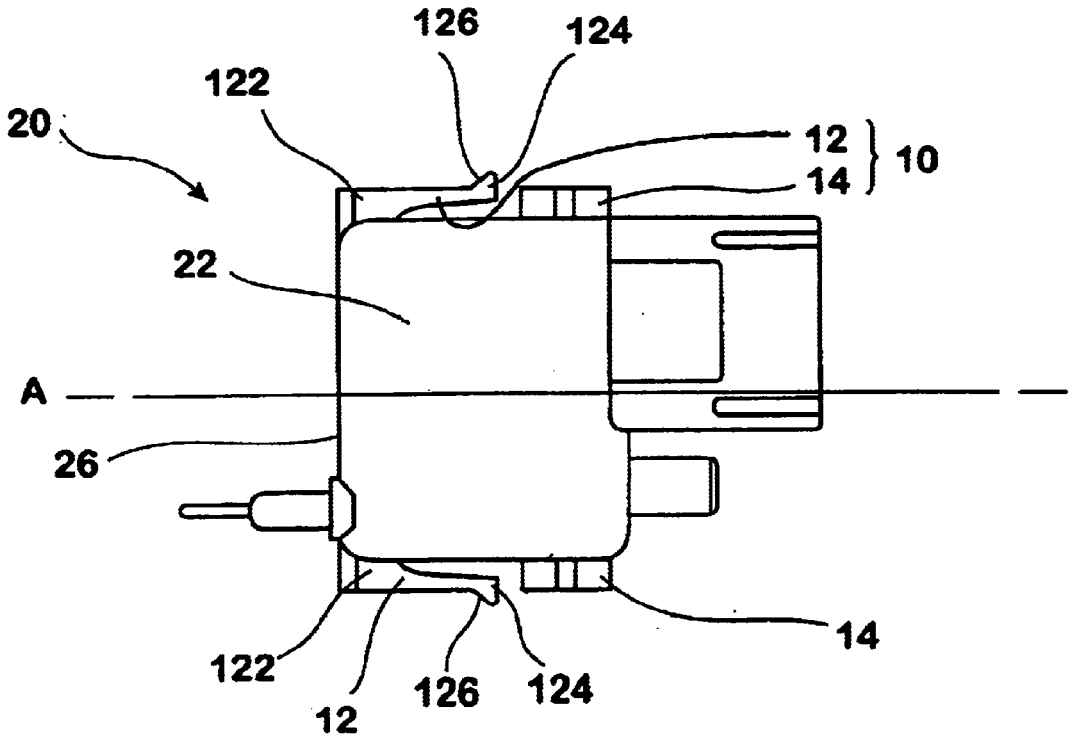
FIG. 1 is a top view of a component having the connection features according to the claimed invention.
Figure 2:
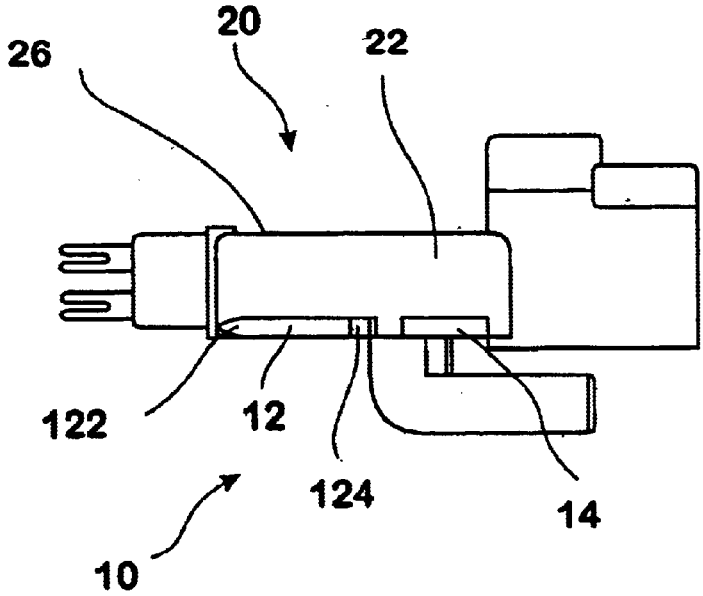
FIG. 2 is a side view of a component having the connection features according to the claimed invention.
Figure 3:
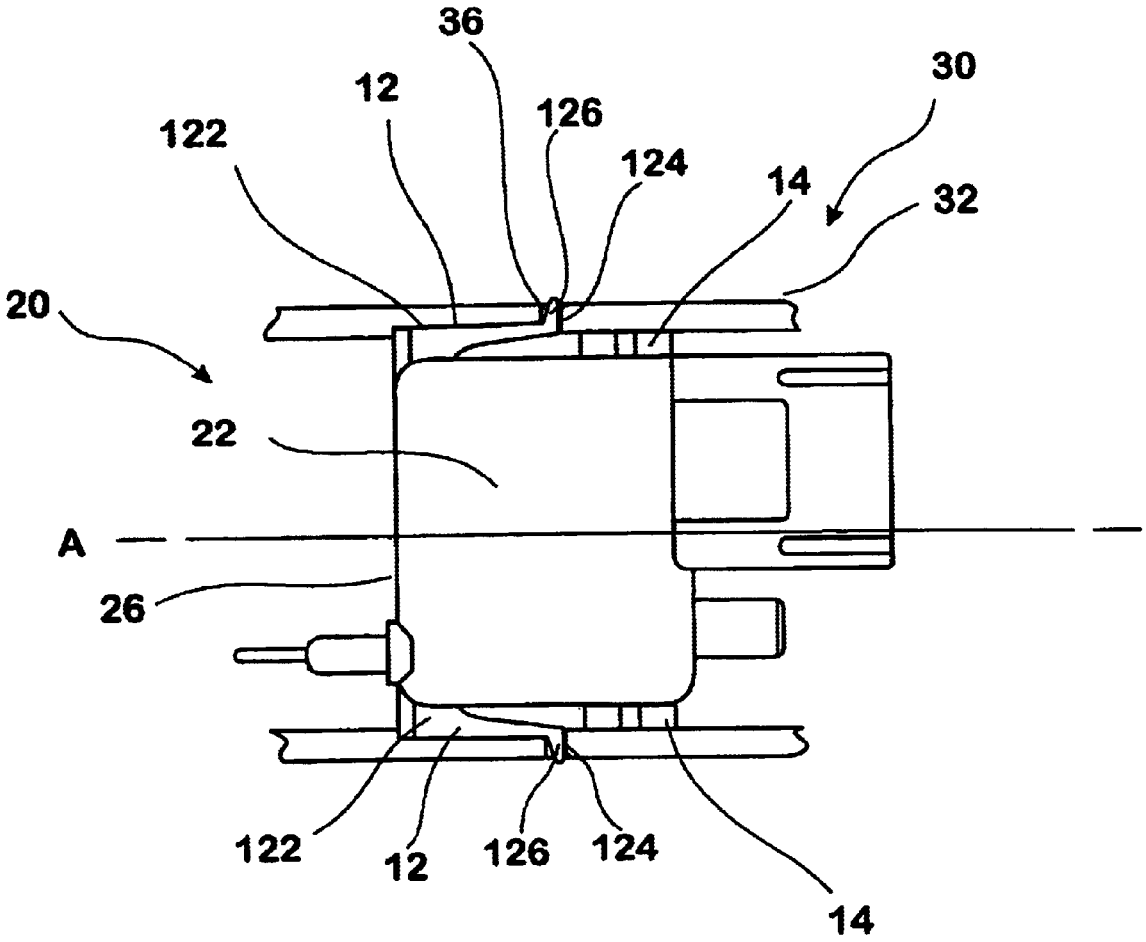
FIG. 3 is a top view of a component secured by the connection system according to the claimed invention.

FIGS. 1–3 illustrate a component incorporating the connection system according to the claimed invention. As shown, the inventive connection system utilizes two different types of projections 10 on the component 20 which interact with a retention surface 30 to removably secure the component 20 in place. In one embodiment, the projections 10 are formed unitarily with the component housing 22. Alternatively, a projection assembly can be formed separately and added on to an existing component. In a further embodiment, the retention surface 30 comprises a pair of grooves 32, each formed with a channel 34 adapted to engage the projections 10. Alternatively, the retention surface 30 can comprise discrete channel sections.

FIGS. 1 and 2 illustrate a component with projections 10 of the present invention unitarily formed with a housing. The component 20 shown is a pressure sensor 26 for an automotive exhaust gas recirculation (EGR) system module 40. It is understood, however, that the connection system according to the claimed invention could be utilized on a range of components of varying size and shape. Further, the inventive system could be made of a variety of materials, provided that the materials exhibited the requisite properties, such as weight, strength, and flexibility. As shown, a pair of first and second projections 12, 14 are disposed on the component housing 22 in a substantially planar arrangement. The projections are arranged symmetrically about an axis A of the component 20, with the first projections 12 spaced from the second projections 14 along the axis A. While the invention is described as using pairs of projections 10, it is envisioned that its advantages could be achieved with a single first and second projection 12,14.

The first projections 12 have a generally elongated shape, with a first end 122 secured to the component housing 22 and a second end 124 slightly offset from the housing 22. These projections 12 are resilient, so that if they are pressed towards the housing 22, they will be resiliently flex away from the housing 22. The second projections 14 may be generally rectangular in shape and are secured to the housing 22 along their length, making them essentially rigid.

FIG. 3 shows the component 20 secured with the connection system according to the claimed invention. The retention surface 30 in the illustrated embodiment comprises a pair of grooves 32, each having a C-shaped channel 34 along the length of an inner surface. The projections 12,14 and the channels 34 are dimensioned so that the projections 12,14 slidingly fit closely within the channels 34. Relative motion between the projections 12,14 and the grooves 32 is limited to sliding motion along the length of the channels 34. Each groove 32 has an aperture 36 for engaging a respective second end 124 of a first projection 12. The apertures 36 are located on the grooves 32 at a position corresponding to the mounting position of the component 20. The features of the grooves 32 are clearly shown in FIG. 4, which shows the sensor 26 mounted on an automotive EGR system module (ESM) 40.

Figure 4:
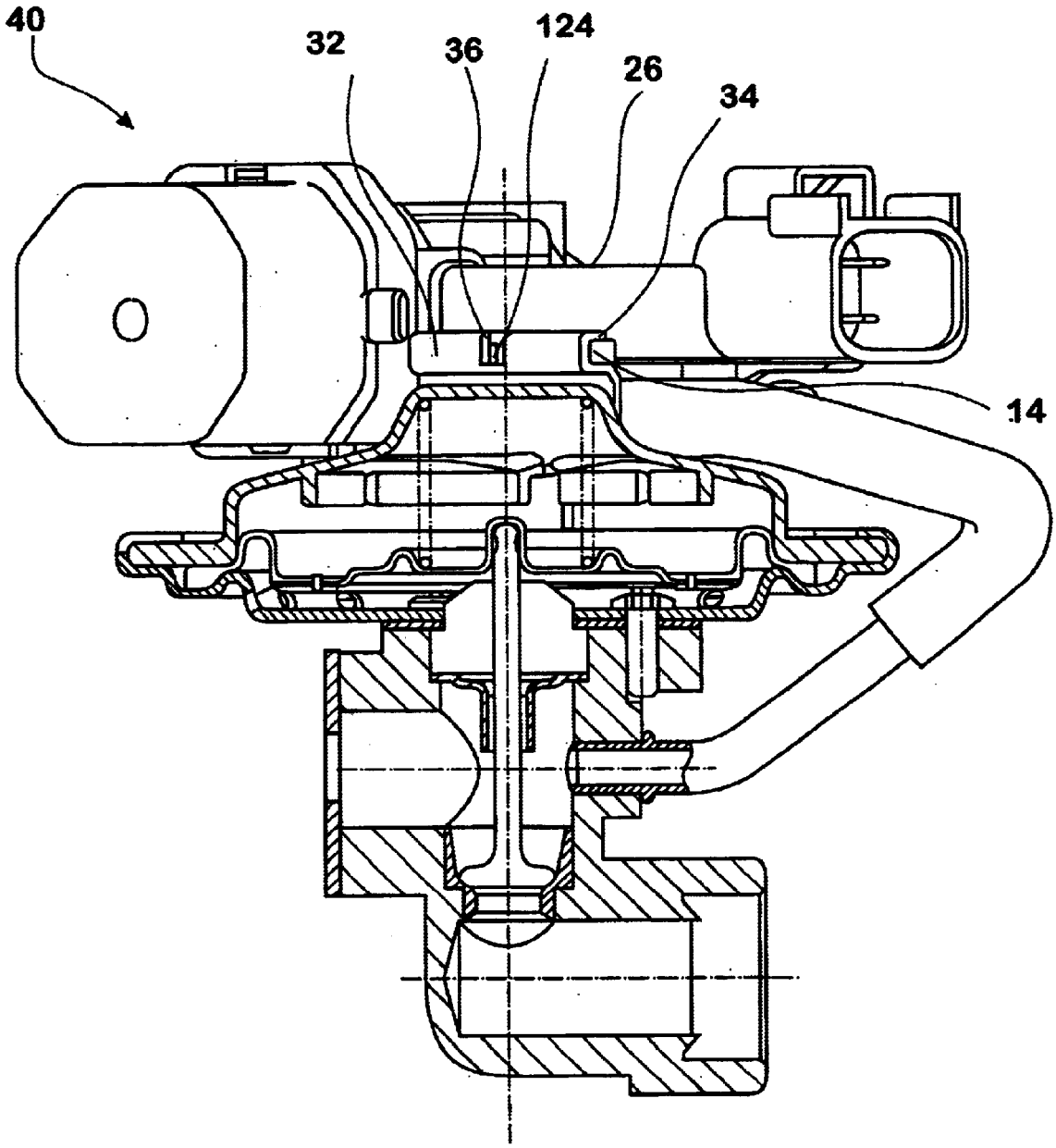
FIG. 4 shows the connection system according to the claimed invention utilized in an automotive assembly.

The operation of the connection system will be described with reference to FIGS. 3 and 4. First, the component 20 to be mounted (in the illustrated example, a sensor 26) is oriented so that the first and second projections 12,14 are aligned with the channel 34 in each groove 32. The component 20 is then displaced along the axis in the connecting direction. As the first projections 12 enter the respective channels 34, the second ends 124 of those projections 12 are forced inwardly. A tip, or angled section, 126 on each second end 124 eases the entry of the second ends 124 into the respective channels 34. Within the channels 34, the first projections 12 exert an outward biasing force on the grooves 32. As the component 20 is advanced further, the second projections 14 enter the channels 34.

The component 20 is displaced until it has reached the desired mounting position. As the mounting position is reached, the second ends 124 of the first projections 12 snap outwardly into the apertures 36 in the respective grooves 32. The snap provides an audible indication that the component 20 is securely fixed. Further, the appearance of the second ends 124 of the projections 12 in the notches 36 provides a visual indication that the component 20 is in place.

Once the component 20 is in place, the first and second projections 12,14 interact with the grooves 32 to provide a locking force on the component 20 in three orthogonal directions. The first projections 12 restrain movement along the axial direction by interacting with the apertures 36 in the grooves 32. The second projections 14 restrain movement in two opposite directions perpendicular to the plane (which includes the axis A) of the component 20. The restraining forces on the second projections 14 are generated by the interaction of the projections 14 with at least two contact surfaces of each channel 34.

The resiliency of the first projections 12 provides the inventive connection system with several additional advantages. Because the spring force of each of the first projections 12 is approximately equal, the projections 12 act to maintain the component 20 in a centered position between the grooves 32. This self-centering feature greatly simplifies installation. Further, due to their flexibility, the first projections 12 serve to reduce the vibration levels encountered by the component 20. Lower vibration levels contribute significantly to a longer operational life for most components.

Lastly, the connection system of the present invention allows for quick removal of components. To remove a component 20, the second ends 124 of the first projections 12 are pressed into the apertures 36 on each groove 32 while the component 20 is pulled in a direction opposite to the mounting direction. Once the first projections 12 have cleared the apertures 36, the first and second projections 12,14 can slide along the channels 34 until the component 20 is removed. Easy mounting and removal facilitates assembly of a device, as well as repair and replacement of individual components.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A system for connecting a male member to a female member, the male and female members being relatively displaceable substantially along an axis lying in a plane, the system comprising:

a pair of first projections each extending parallel to the plane and each having a first end spaced from a second end, each first end being fixed to a first one of the male and female members, and each second end being resiliently movable with respect to the first member, each second end including a first one of a cavity feature and a protrusion feature, and each first projection including a pair of first faces;

a pair of grooves in a second one of the male and female members, each groove extending parallel to the axis receiving a respective one of the pair of first projections, and each groove including a second one of the cavity feature and the protrusion feature, the second feature cooperatively engaging the first feature such that the first member is centered about the axis with respect to the second member and such that the first member is retained along the axis with respect to the second member, and each groove including at least two surfaces slidingly confronting respective ones of the pair of first faces and preventing relative displacement of the first and second members perpendicular to the plane; and at least one second projection fixed to the first member and extending parallel to the plane, each second projection including a pair of second faces slidingly engaging respective ones of the pair of grooves and preventing relative displacement of the first and second members perpendicular to the plane.

2. The system according to claim 1, wherein there are a pair of the second projections, each of the second projections slidingly engaging respective surfaces of corresponding ones of the pair of grooves.

3. The system according to claim 2, wherein the pair of first projections, the pair of grooves, and the pair of second projections commonly lie in the plane.

4. The system according to claim 1, wherein each second projection is substantially rigidly fixed to the first member.

5. A system for connecting a male member to a female member, the male and female members being relatively displaceable substantially along an axis lying in a plane, the system comprising:

a pair of first projections each extending parallel to the plane and each having a first end spaced from a second end, each first being fixed to a first one of the male and female members, each second end being resiliently movable with respect to the first member to absorb relative vibration between the male and female members, and each first projection including a pair of first faces;

a pair of grooves in a second one of the male and female members, each groove extending parallel to the axis and receiving a respective one of the pair of first projections, and each groove including at least two surfaces slidingly confronting respective ones of the pair of first faces and preventing relative displacement of the first and second members perpendicular to the plane;

a tip formed on each second end and an aperture extending from each groove through the second member, each tip tapering from a first size at least as large as its corresponding aperture to a second size smaller than the corresponding aperture, and each tip cooperatively engaging its corresponding aperture such that the first member is centered about the axis with respect to the second member and such that the first member is retained along the axis with respect to the second member; each tip being visible in its corresponding aperture when the first member is retained along the axis with respect to the second member; and a pair of second projections fixed to the first member and extending parallel to the plane, each second projection having at least two second faces slidingly engaging corresponding surfaces in respective ones of the pair of grooves to prevent relative displacement of the first and second members perpendicular to the plane.

6. A method of connecting a male member to a female member, the male and female members being relatively displaceable substantially along axis lying in a plane, the method comprising:

providing a first one of the male and female members with a pair of first projections each extending parallel to the plane and each having a first end spaced from a second end, each first end being fixed to the first member, and each second end being resiliently movable with respect to the first member, each second end including a first one of a cavity feature and a protrusion feature, and each first projection including a pair of first faces;

providing a second one of the male and female members with a pair of grooves, each groove extending parallel to the axis and receiving a respective one of the pair of first projections, each groove including a second one of the cavity feature and the protrusion feature, and each groove including at least two surfaces;

aligning the male member with respect to the female member along the axis such that each groove will receive a respective one of the pair of first projections such that each of the first faces slidingly confronts a respective one of the surfaces so as to prevent relative displacement of the first and second members perpendicular to the plane;

relatively displacing the male member with respect to the female member until the second feature cooperatively engages the first feature such that the first member is centered about the axis with respect to the second member, the first member is retained along the axis with respect to the second member, and relative vibration between the first and second members is absorbed; and providing the first member with a pair of second projections extending parallel to the plane, each second projection including a pair of second faces slidingly engaging respective ones of the pair of grooves such that the first and second members are prevented from relative displacement perpendicular to the plane.

7. The method according to claim 6, wherein the protrusion feature is visible in the cavity feature when the first member is retained along the axis with respect to the second member.

8. A system for connecting an electrical component to a device comprising:

a module member;

an electrical component member including a first electrical connector adapted to be connected to a mating second electrical connector, the module and electrical component members being relatively displaceable substantially along an axis lying in a plane;

a pair of first projections each extending parallel to the plane and each having a first end spaced from a second end, each first end being fixed to a first one of the electrical component member and the module member, and each second end being resiliently movable with respect to the first one of the electrical component member and the module member, each second end including a first one of a cavity feature and a protrusion feature, and each first projection including a pair of first faces; and a pair of grooves in a second one of electrical component member and the module member, each groove extending parallel to the axis and receiving a respective one of the pair of first projections, and each groove including a second one of the cavity feature and the protrusion feature, the second feature cooperatively engaging the first feature such that the electrical component member is centered about the axis with respect to the module member and such that the electrical component member is retained along the axis with respect to the module member, and each groove including at least two surfaces slidingly confronting respective ones of the pair of first faces and preventing relative displacement of the electrical component member and the module member perpendicular to the plane.

9. The system according to claim 8, wherein each second end being resiliently movable absorbs relative vibration between the module and electrical component members.

10. The system according to claim 8, further comprising:

at least one second projection fixed to the electrical component member and extending parallel to the plane, each second projection including a pair of second faces slidingly engaging respective ones of the pair of grooves and preventing relative displacement of the electrical component and module members perpendicular to the plane.

11. The system according to claim 10, wherein each second projection is substantially rigidly fixed to the electrical component member.

* * * * *